US006142257A

United States Patent [19]

Bruener et al.

[11] Patent Number: 6,142,257

[45] Date of Patent: Nov. 7, 2000

[54] OIL PICKUP TUBE FOR INTERNAL COMBUSTION ENGINE

[75] Inventors: Patrick Bruener, Hartland; Glen Eifert, Hartford, both of Wis.

[73] Assignee: Briggs and Stratton Corporation, Milwaukee, Wis.

[21] Appl. No.: 09/114,389

[22] Filed: Jul. 13, 1998

[51] Int. Cl.[7] ..... F16N 13/22; F16N 25/00

[52] U.S. Cl. ..... 184/12; 184/106; 123/196 R; 123/195; 227/382; 227/464.1; 227/464.7

[58] Field of Search ..... 184/12, 106, 1.5; 123/196 R, 195 C; 222/382, 464.1, 464.7

[56] References Cited

U.S. PATENT DOCUMENTS

| | | | |
|---|---|---|---|
| 4,101,003 | 7/1978 | Timour et al. | 184/106 |
| 4,114,783 | 9/1978 | Wempe et al. | 222/398 |
| 4,239,026 | 12/1980 | Streicher et al. | 123/196 R |
| 5,088,579 | 2/1992 | Kim et al. | 184/6.16 |
| 5,130,014 | 7/1992 | Volz | 210/310 |
| 5,402,643 | 4/1995 | Buchanan et al. | 60/605.3 |
| 5,660,539 | 8/1997 | Matsunaga et al. | 418/55.6 |
| 5,887,565 | 3/1999 | Ozeki et al. | 123/196 R |

*Primary Examiner*—Thomas R. Hannon
*Assistant Examiner*—Colby Hansen
*Attorney, Agent, or Firm*—Michael Best & Friedrich LLP

[57] ABSTRACT

An oil pickup tube includes a substantially straight portion, and a top and bottom portion interconnected with the straight portion. Each portion includes a cavity in fluid flow communication with the cavities of the other portions. Each cavity includes a substantially linear longitudinal axis. The cavities also include draft angles to allow the respective portions to be manufactured by injection molding, casting, or another suitable method. The top portion includes at least one recess adapted to receive a sealing member that creates a press-fit seal when the top portion is inserted into an oil gallery of an engine. Top and bottom flanges interconnected with the oil pickup tube facilitate securing the tube to the engine. A method for manufacturing the oil pickup tube includes the steps of defining the outer surface of the tube with a die, inserting two cores corresponding to the respective cavities of the top, straight, and bottom portions into the die, and delivering molten material into the die. After the material has at least partially cooled and solidified, the oil pickup tube is removed from the die.

77 Claims, 6 Drawing Sheets

FIG. 4
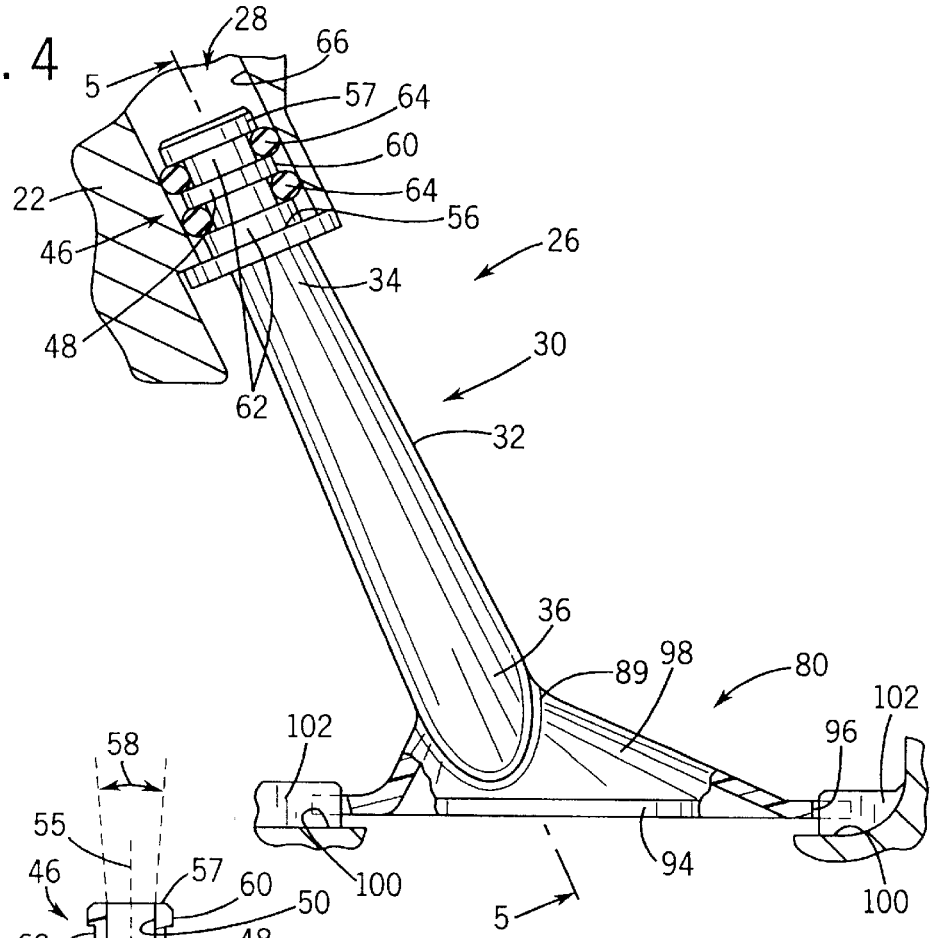
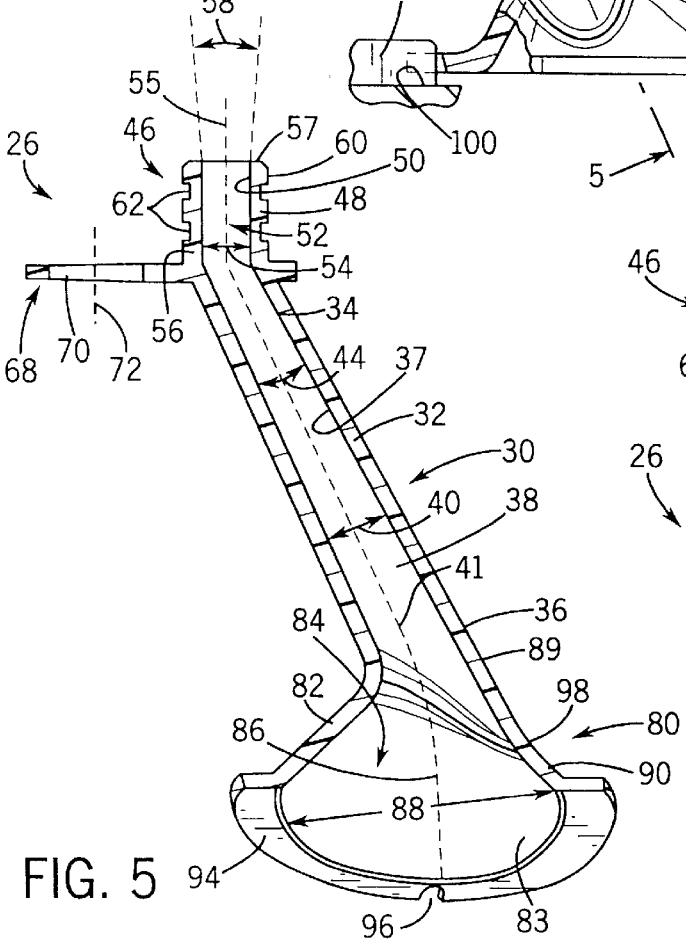
FIG. 5
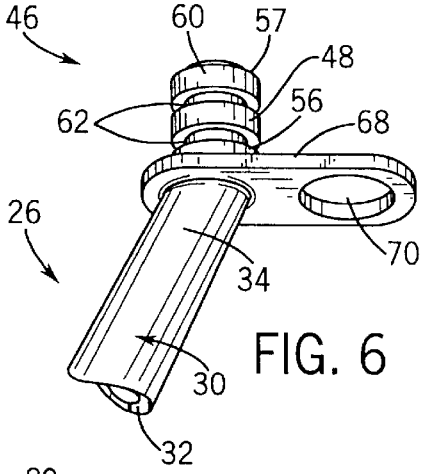
FIG. 6

OIL PICKUP TUBE FOR INTERNAL COMBUSTION ENGINE

BACKGROUND

The invention relates to internal combustion engines with pressurized lubrication systems, and more particularly to oil pickup tubes for internal combustion engines.

Prior art oil pickup tubes used in the sump of an internal combustion engine are typically made of metal parts which are cast, stamped, or extruded and then machined and assembled. Metal tubes provide enough structural stability to withstand vibrational forces generated by the engine while running. However, the cost and complexity of manufacturing such oil pickup tubes can be significant.

SUMMARY

An oil pickup tube is provided that has a substantially straight portion. The straight portion includes a straight portion wall, a top end, and a bottom end. The straight portion wall has an inner surface that at least partially defines a straight portion cavity that extends between the top end and the bottom end of the straight portion. The straight portion cavity has a substantially linear longitudinal axis.

A width of the straight portion cavity increases or widens substantially monotonically from the top end to the bottom end, creating a draft angle. The straight portion cavity may therefore at least partially correspond to any three-dimensional shape, either symmetrical, asymmetrical, regular, or irregular, that substantially monotonically increases or widens from the top end to the bottom end. For example, the straight portion cavity may at least partially correspond to the shape of at least one of a cone, a truncated cone, a pyramid, a truncated pyramid, and a frustum.

The oil pickup tube also includes a top portion interconnected or formed integrally with the top end of the straight portion. The top portion includes a top portion wall. The top portion wall includes an inner surface that at least partially defines a top portion cavity in fluid flow communication with the straight portion cavity. The top portion cavity includes a substantially linear longitudinal axis.

A width of the top portion cavity increases or widens substantially monotonically from a first end of the top portion adjacent the top end of the straight portion to a second, opposite end. This creates a draft angle within the top portion cavity. The shape of the top portion cavity may, therefore, at least partially correspond to a three-dimensional shape that substantially monotonically increases or widens from the first end to the second end of the top portion. For example, the top portion cavity may at least partially correspond to the shape of at least one of a cone, a truncated cone, a pyramid, a truncated pyramid, and a frustum.

The top portion wall also includes an outer surface having at least one recess formed therein, the recess receiving at least one sealing member, such as an O-ring. The top portion is adapted to be inserted into an oil gallery in an engine that is in fluid flow communication with an oil pump. When the oil pickup tube is so inserted, the sealing member creates a seal, allowing the oil pump to create a partial vacuum in the oil gallery and the oil pickup tube to draw a lubricating fluid such as oil or a synthetic lubricant out of the sump.

A top flange is oriented substantially normal to the top portion longitudinal axis. The top flange is interconnected or formed integrally with the oil pickup tube adjacent the junction of the top end of the straight portion and the first end of the top portion. The top flange defines an aperture having a centerline substantially parallel to the top portion longitudinal axis. A fastener may be passed through the aperture to secure the oil pickup tube to the engine block. One or more additional flanges may be interconnected or formed integrally with the straight portion or top portion and used to further secure the oil pickup tube to the engine block.

The oil pickup tube also includes a bottom portion having a bottom portion wall. The bottom portion wall has an inner surface at least partially defining a bottom portion cavity having a substantially linear longitudinal axis. The bottom portion cavity is in fluid flow communication with the straight portion cavity, and includes a width that substantially monotonically increases or widens from a first end of the bottom portion adjacent the bottom end of the straight portion to a second, opposite end of the bottom portion. This creates a draft angle in the bottom portion cavity. The shape of the bottom portion cavity may at least partially correspond to any three-dimensional shape that substantially monotonically increases or widens from the first end to the second end of the bottom portion. For example, the bottom portion cavity may at least partially correspond to the shape of at least one of a cone, a truncated cone, a pyramid, a truncated pyramid, and a frustum.

The bottom portion may also include a bottom flange, formed integrally with an outer surface of the bottom portion wall. The bottom flange may have at least one of a slot or a tab formed therein. The at least one slot or tab cooperates with at least one corresponding tab or slot formed in the sump of the engine. This tab-and-slot arrangement serves the two-fold purpose of restraining the oil pickup tube from movement within the engine, and properly locating the oil pickup tube for ease of installation. Restraining means other than the tab-and-slot arrangement described above can also be used. For instance, the oil pickup tube can be interconnected with the sump with fasteners or clips, with or without the use of the bottom flange.

The oil pickup tube is preferably manufactured by plastic injection molding, but can also be made by other types of molding or casting and with other materials, such as aluminum alloys or other metals. Also, the oil pickup tube could be manufactured as two or more separate pieces that are later thermally or mechanically joined to form the oil pickup tube.

In the preferred method, however, a two-piece die is provided that defines the outer surface of the oil pickup tube, including the top flange. Two core members are inserted into the die, leaving a space between the core members and the die corresponding to the walls of the straight, top, and bottom portions.

The first core member includes a top flange aperture pin or core and a top portion cavity pin or core. Because of the relative orientations of the top portion cavity and the aperture in the top flange, the top flange aperture pin and the top portion cavity pin are substantially parallel in the preferred embodiment. The second core member and the die together form the straight portion cavity, the bottom portion cavity, and the bottom flange.

After the core members are properly inserted into the die, molten plastic material is injected through an injection conduit in fluid flow communication with the space between the die and the core members to form the oil pickup tube as one piece. Alternative means for delivering the plastic, such as pouring or blowing, can be used. When the plastic has at least partially cooled and solidified, the core members are removed and the two-piece die separated, completing the manufacturing process. The respective draft angles of the top, straight, and bottom portion cavities facilitate removal of the cores.

The invention includes alternative methods for manufacturing the oil pickup tube. For example, the first core member may only include the top portion cavity pin, with the top flange aperture pin being independent of the first core member. The first or second core member may be stationary with respect to the two-piece die and the other core member. A single-piece die or a die having more than two pieces may also be used.

It is an advantage of the present invention to provide an oil pickup tube that is economically manufactured by casting or molding.

It is a further advantage of the present invention to provide a method of manufacturing an oil pickup tube by an inexpensive casting or molding process.

BRIEF DESCRIPTION OF DRAWINGS

FIG. 4 is a side view of the oil pickup tube, shown in partial section.

FIG. 5 is a side cross sectional view of the oil pickup tube, taken along line 5—5 in FIG. 4.

FIG. 6 is a side view of a portion of the oil pickup tube.

DETAILED DESCRIPTION

Figure 1:
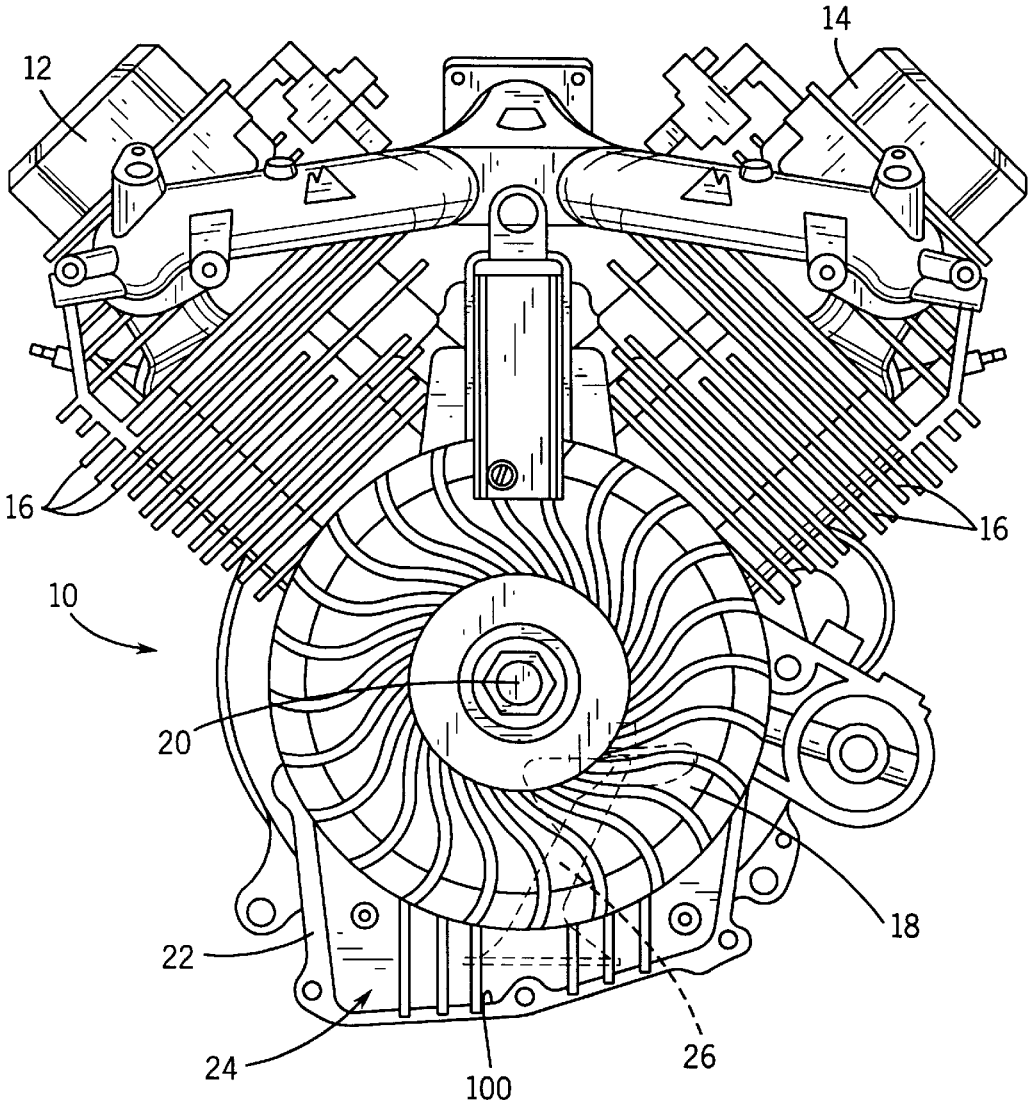
FIG. 1 is an end view of an internal combustion engine incorporating the invention.

FIG. 1 illustrates a two-cylinder air-cooled internal combustion engine 10 having a pressurized lubrication system, that may be used in a motor vehicle, for example. The engine 10 includes first and second cylinders 14, 12 having cooling fins 16 extending therefrom. A fan 18 is mounted for rotation with, and at an end of, an engine crankshaft 20. The engine 10 also includes an engine block or engine housing 22 defining a sump 24. The sump 24 extends partially beneath the fan 18, and holds a lubricating fluid such as engine oil or synthetic lubricant for lubricating bearings and other frictional surfaces of the engine 10.

Figure 2:
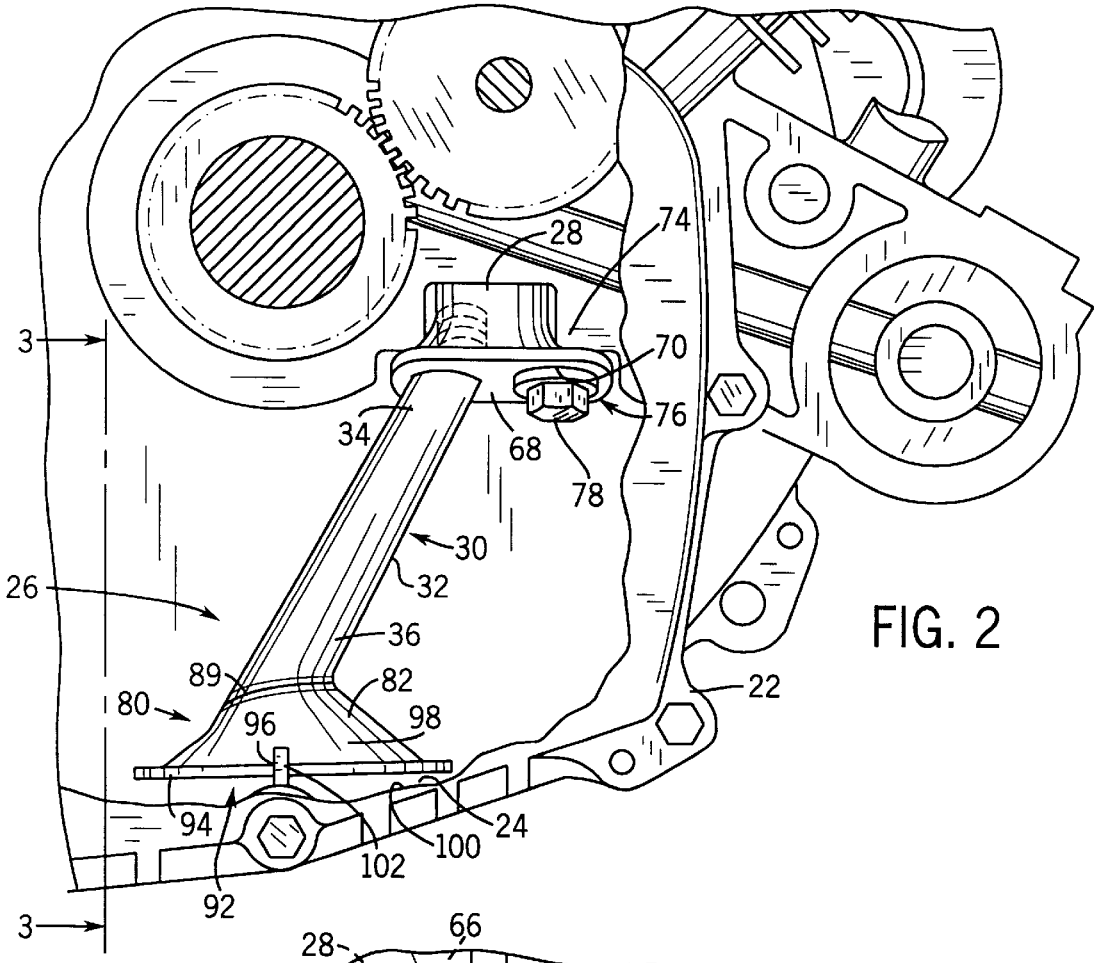
FIG. 2 is an exploded end view of a portion of the internal combustion engine.
Figure 3:
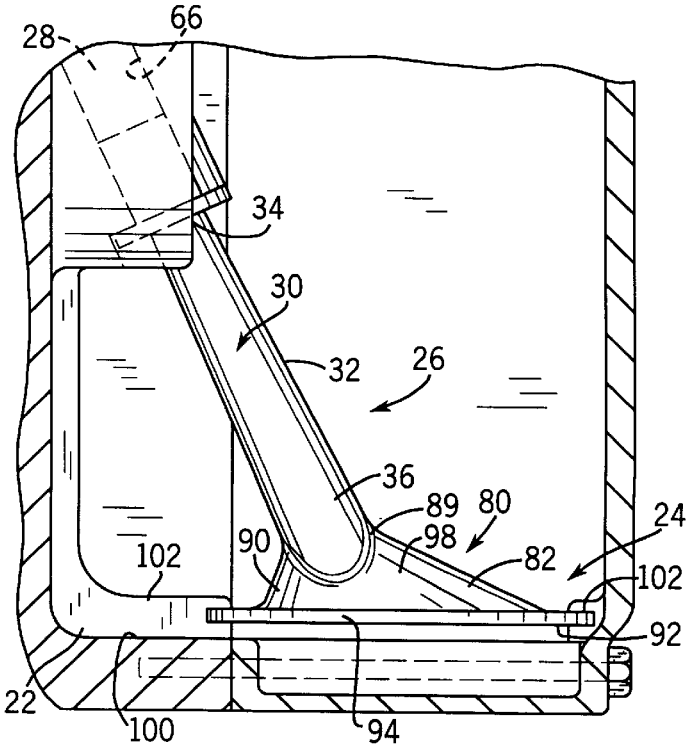
FIG. 3 is a view taken along line 3—3 in FIG. 2.

Referring to FIGS. 2 and 3, an oil pickup tube 26 is positioned generally within the sump 24. The oil pickup tube 26 is in fluid flow communication with the lubricating fluid in the sump 24, and with an oil gallery 28 formed in the engine block 22. The oil gallery 28 is in fluid flow communication with an oil pump (not shown) interconnected with the engine block 22. This configuration places the oil pump in fluid flow communication with the lubricating fluid through the oil gallery 28 and the oil pickup tube 26.

As seen in FIGS. 2–5, the oil pickup tube 26 includes a substantially straight portion 30 having a straight portion wall 32. The straight portion wall 32 has a top end 34, a bottom end 36, and an inner surface 37. The inner surface 37 at least partially defines a straight portion cavity 38 having a width 40 and a substantially linear longitudinal axis 41. The straight portion cavity 38 extends from the top end 34 to the bottom end 36.

The width 40 of the straight portion cavity 38 is relatively small at the top end 34, and substantially monotonically increases or widens to a larger width at the bottom end 36, thereby creating a draft angle 44. As used herein, "substantially monotonically increases" means substantially never decreasing, and includes a width that remains constant or stays the same in some places for a length no greater than 2 inches and a width that may decrease no greater than 0.020 inches. Due to the shrinkage and compressibility of the plastic material, it may be possible to keep the width the same or have the width slightly decrease and still remove the oil pickup tube from the die.

The straight portion cavity 38 may correspond to any three-dimensional shape, either symmetrical or asymmetrical, and either regular or irregular, that substantially monotonically increases or widens from the top end 34 to the bottom end 36. For example, the straight portion cavity 38 may at least partially correspond to the shape of at least one of a cone, a truncated cone, a pyramid, a truncated pyramid, and a frustum. In the preferred embodiment, the straight portion cavity 38 has a shape corresponding to an irregular truncated cone.

Referring to FIGS. 4–6, a top portion 46 is interconnected with the top end 34 of the straight portion 30. In the preferred embodiment, the top portion 46 and the straight portion 30 are integrally formed as a single piece, but the top portion 46 and the straight portion 30 may also be separately manufactured and thermally or mechanically joined. The top portion 46 includes a top portion wall 48 having an inner surface 50 at least partially defining a top portion cavity 52. The top portion cavity 52 includes a width 54 and a substantially linear longitudinal axis 55. The top portion cavity 52 is in fluid flow communication with the straight portion cavity 38.

As best seen in FIG. 5, the width 54 of the top portion cavity 52 is relatively small at a first end 56 where the top portion 46 meets the straight portion 30, and substantially monotonically increases or widens to a larger width at a second or opposite end 57, thereby creating a draft angle 58. The top portion cavity 52 may correspond to any three-dimensional shape, either symmetrical or asymmetrical, and either regular or irregular, that substantially monotonically increases or widens from the first end 56 to the second end 57. For example, the top portion cavity 52 may at least partially correspond to the shape of at least one of a cone, a truncated cone, a pyramid, a truncated pyramid, and a frustum. In the preferred embodiment, the top portion cavity 52 is generally frusto-conical in shape.

Referring now to FIG. 4, the top portion wall 48 includes an outer surface 60 having a pair of recesses 62 formed therein. A sealing member 64 is received within each recess 62, and projects beyond the outer surface 60 in a radial direction. In the preferred embodiment, the recesses 62 are generally circular in shape, and the sealing members 64 are O-rings. The sealing members 64 abut an inner surface 66 of the oil gallery 28, thereby creating a seal, when the oil pickup tube 26 is in its operating position. It should be noted that a single recess 62 and sealing member 64 may be used in alternative embodiments of the invention, or more than two recesses 62 and sealing members 64 may be used depending on the sealing requirements for a given oil pickup tube, oil gallery, and oil pump. Also, alternative sealing methods may be used.

Referring to FIGS. 2–6, a top flange 68 is oriented substantially normal to the top portion longitudinal axis 55 (see FIG. 5). In the preferred embodiment, the top flange 68 is formed integrally with the oil pickup tube 26 as a single piece, but the top flange 68 may also be separately manufactured and mechanically or thermally joined to the oil pickup tube 26. The top flange 68 is interconnected with the oil pickup tube 26 adjacent the junction of the top end 34 of the straight portion 30 and the top portion 46.

The top flange 68 includes an aperture 70 having a centerline 72 that is substantially parallel to the longitudinal axis 55 of the top portion cavity 52. When the oil pickup tube 26 is properly installed in the engine 10, the aperture 70 aligns with a corresponding threaded bore 74 in the engine block 22 (see FIG. 2).

The configurations of different engines may require or permit two or more flanges in different orientations than the one shown in the drawings of the preferred embodiment. The top flange 68 in the preferred embodiment and additional flanges required for other engines are not required to be transversely disposed to be within the scope of the invention. The top flange 68 may not be necessary at all in some situations where other means are used to attach the tube, e.g., the oil pickup tube 26 fits tightly enough in the oil gallery 28 to hold the oil pickup tube 26 in place without the assistance of the top flange 68.

Referring now to FIGS. 2–3, a fastener 76, such as a threaded bolt, having a fastener head 78 may be passed through the top flange aperture 70 and threaded into the threaded bore 74. The head 78 of the fastener 76 holds the oil pickup tube 26 in place against the engine block 22, and prevents the oil pickup tube 26 from sliding out of the oil gallery 28. Other means for retaining the oil pickup tube 26 in fluid flow communication with the oil gallery 28, such as clamps and tabs and grooves, may be used instead of, or in addition to, the fastener 76 without departing from the spirit and scope of the invention.

Referring to FIGS. 2–5, a bottom portion 80 is interconnected with the bottom end 36 of the straight portion 30. In the preferred embodiment, the bottom portion 80 and the straight portion 30 are integrally formed as a single piece, but the bottom portion 80 and the straight portion 30 may also be separately manufactured and thermally or mechanically joined. The bottom portion 80 includes a bottom portion wall 82 having an inner surface 83. The inner surface 83 at least partially defines a bottom portion cavity 84, having a substantially linear longitudinal axis 86 and a width 88.

Figure 7:
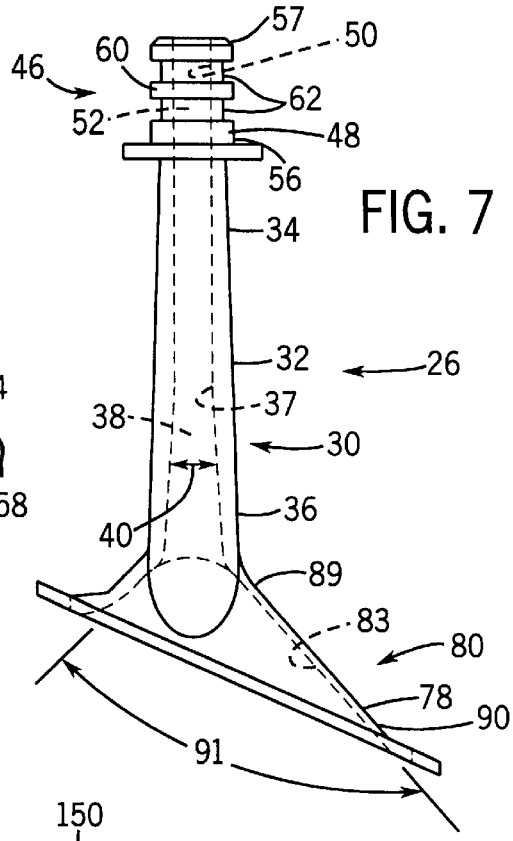
FIG. 7 is a side view the oil pickup tube with the inner surfaces of the walls of the top, straight, and bottom portions shown in phantom.

The bottom portion cavity 84 is in fluid flow communication with the straight portion cavity 38. The width 88 of the bottom portion cavity 84 is relatively small at a first end 89 of the bottom portion 80 adjacent the bottom end 36 of the straight portion 30, and substantially monotonically increases or widens to a larger width at a second or opposite end 90, thereby creating a draft angle 91 (see FIG. 7). The bottom portion cavity 84 may correspond to any three-dimensional shape, either symmetrical or asymmetrical, and either regular or irregular, that substantially monotonically increases or widens from the first end 89 to the second end 90. For example, the bottom portion cavity 84 may at least partially correspond to the shape of at least one of a cone, a truncated cone, a pyramid, a truncated pyramid, and a frustum.

In the preferred embodiment, the straight portion longitudinal axis 41 intersects the bottom portion longitudinal axis 86 at a non-zero angle, and the bottom portion cavity 84 corresponds to the shape of an irregular truncated cone. The arrangement of internal components of other engines may require or permit the straight portion longitudinal axis 41 to meet the bottom portion longitudinal axis 86 at an angle of zero degrees. In that case, the bottom portion cavity 84 would correspond to a regular frusto-conical or another shape.

With reference to FIGS. 1–3, the bottom portion 80 is shaped to best utilize space within the engine 10. The non-zero angle between straight portion longitudinal axis 41 and the bottom portion longitudinal axis 86 allows the oil pickup tube to extend into the sump at an angle in the preferred embodiment. This provides access to the lubricating fluid in the sump 24 under the fan 18. The shapes of the bottom portion 80 and the straight portion 30 also allow the lubricating fluid to be drawn out of the sump 24 through an oil pickup tube that is substantially free from bends. A screen 92 may be positioned across the bottom portion 80 to prevent foreign matter from entering the engine 10.

As seen in FIGS. 3–5, and 8, the bottom portion 80 may include a bottom flange 94 having a pair of slots 96 formed therein. The bottom flange 94 is preferably integrally formed around an outer surface 98 of bottom portion 80, but may be separately manufactured and mechanically or thermally joined to the bottom portion 80. Formed in the sump 24, and extending from a bottom surface 100 thereof, are a pair of tabs or ribs 102 corresponding to the slots 96 in the bottom flange 94 when the oil pickup tube 26 is properly installed.

When the oil pickup tube 26 is properly installed, the ribs 102 are snugly received within the slots 96 to resist lateral movement of the oil pickup tube 26 in response to engine vibration. The ribs 102 and slots 96 also serve to properly locate the oil pickup tube 26 within the sump 24 when the engine 10 is assembled.

The oil pickup tube 26 may be secured within the sump 24 by other means, such as fasteners or clips. Alternatively, the oil pickup tube 26 may be sufficiently secured in the sump 24 by a press fit in the oil gallery 28 and by the top flange 68 and fastener 76, in which case the bottom flange 94 may or may not be necessary. The slots 96 may be oriented anywhere along the flange 94, but are diametrically opposed in the preferred embodiment. Also, the bottom flange 94 and the engine 10 may be respectively provided with a single slot 96 and a single tab 102 in some cases, or more than two slots and tabs if more stability is desired. Lastly, the tab-and-slot arrangement may be reversed, with at least one tab 102 provided on the flange and at least one slot 96 provided in the sump.

The shapes of the top portion 46, straight portion 30, and bottom portion 80 may be modified for use with engines other than the one illustrated in the drawings. The invention is intended to allow some modification to the shapes and orientations of the various features described above to accommodate many different types of engines having different configurations of internal components.

The oil pickup tube 26 may be manufactured by several different molding and casting methods, including but not limited to injection molding, blow molding, sand casting, and two or more piece molding or casting followed by thermally or mechanically joining the two or more pieces together. A die used for such molding and casting may have one piece depending on the specific geometry of the oil tube and the compressibility of the material used. The die may also have two or more pieces. Also, many different materials including plastic and metal, such as an aluminum alloy, may be molded or cast to form the oil pickup tube 26.

In the preferred method, however, and as best seen in FIGS. 8–12, a two-piece die 150 having first and second pieces 152, 154, is brought together to form the outer surfaces of the oil pickup tube 26 including the top flange 68, but not including the bottom flange 94. Then a first and a second core member 156, 158 are at least partially inserted into the die 150.

Referring to FIGS. 9–12, the first core member 156 includes a top portion cavity core or pin 160 and a top flange aperture core or pin 162. Because of the particular orientation of the top portion cavity 52 and the top flange aperture 70 in the preferred embodiment, the top portion cavity pin 160 and the top flange aperture pin 162 are substantially parallel to each other. This allows both the top portion cavity pin 160 and the top flange aperture pin 162 to be incorporated in the first core member 156.

The top portion cavity pin 160 corresponds to the shape of the top portion cavity 52, including the draft angle 58 thereof. The top portion cavity pin 160 and the top flange aperture pin 162 are inserted through first and second apertures 164, 166 in the two-piece die 150 when the two-piece die 150 is brought together (see FIG. 9). When the top portion cavity pin 160 is so inserted, a space 168 (see FIG. 9) is provided between the top portion cavity pin 160 and the two-piece die 150 corresponding to the top portion wall 48 for injecting plastic or other material therein as described below.

Referring now to FIGS. 8–11, an insert portion 170 of the second core member 158 corresponds in shape to the straight and bottom portion cavities 38, 84 of the oil pickup tube 26. The insert portion 170 of the second core member 158 is inserted into a third aperture 172 in the two-piece die 150 when the two-piece die 150 is brought together. A space 174 (see FIG. 9), corresponding to the straight and bottom portion walls 32, 82, is provided between the insert portion 170 of the second core member 158 and the two-piece die 150 for injecting plastic or other material therein as described below.

Figure 8:
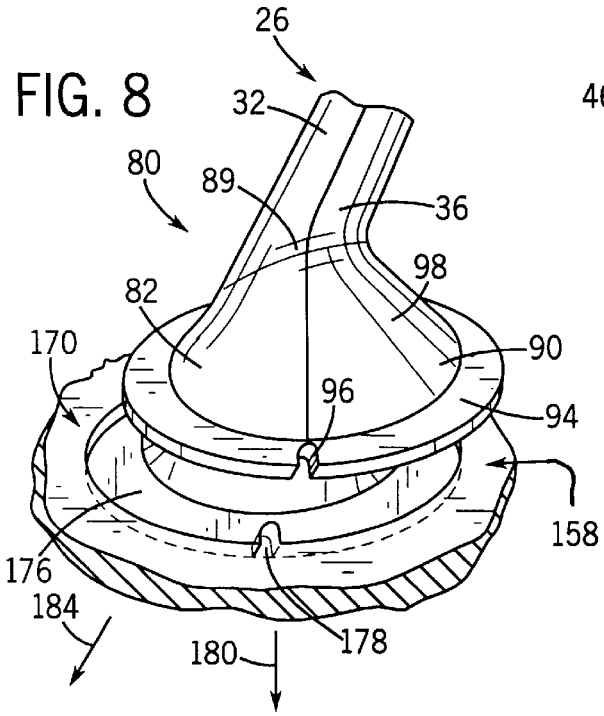
FIG. 8 is a view of a portion of the oil pickup tube and a core partially removed therefrom.

As best seen in FIG. 8, the second core member 158 includes a recess 176 that corresponds to the shape of the bottom flange 94. A pair of tabs 178 are included in the second core member 158 to form the slots 96 in the bottom flange 94. The tabs 178 are angled to facilitate removal of the second core member 158 from the oil pickup tube 26 as described below.

Figure 9:
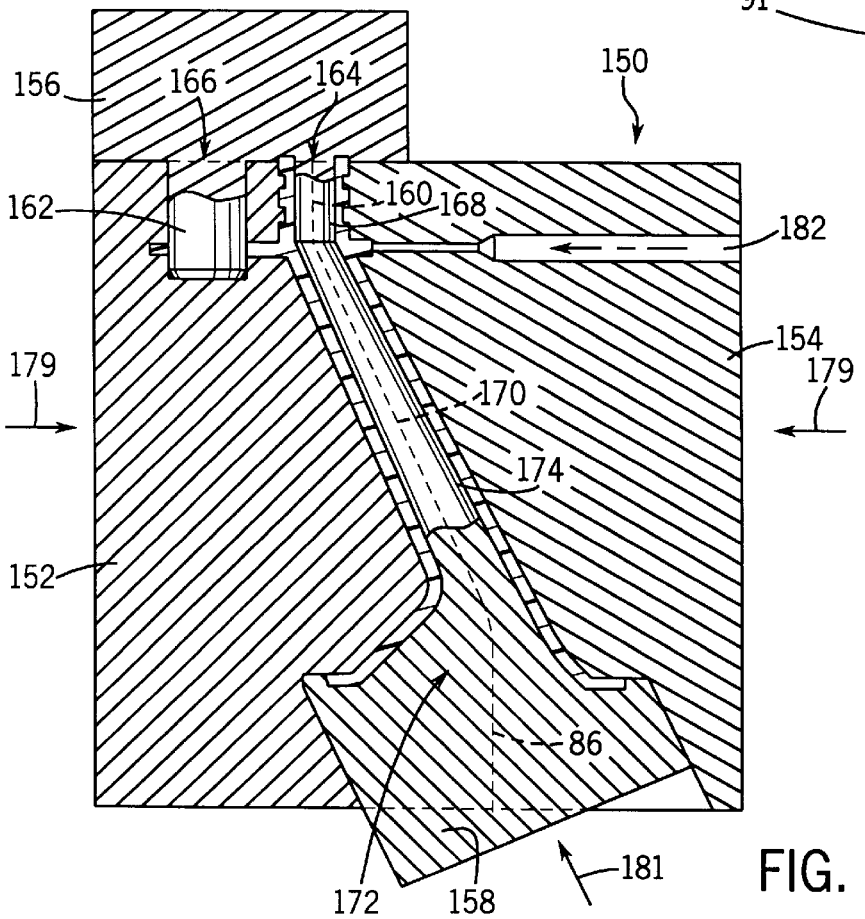
FIG. 9 is a side sectional view of a die used to form the oil pickup tube.

The preferred method for making the oil pickup tube 26 includes the following steps. Referring to FIG. 9, the first and second pieces 152, 154 of the two-piece die 150 are first brought together in the directions indicated by arrows 179 to define an outer surface of the oil pickup tube 26. Then the first and second core members 156, 158 are inserted into the first, second, and third apertures 164, 166, 172 of the die 150 in the directions indicated by the arrows 180, 181. Then molten plastic or other material is injected through an injection conduit 182 (see FIGS. 9–10) into the spaces 168, 174 between the two-piece die 150 and the core members 156, 158 to form the oil pickup tube 26 as one piece. Alternative means for delivering the plastic, such as pouring or blowing, can be used.

Figure 10:
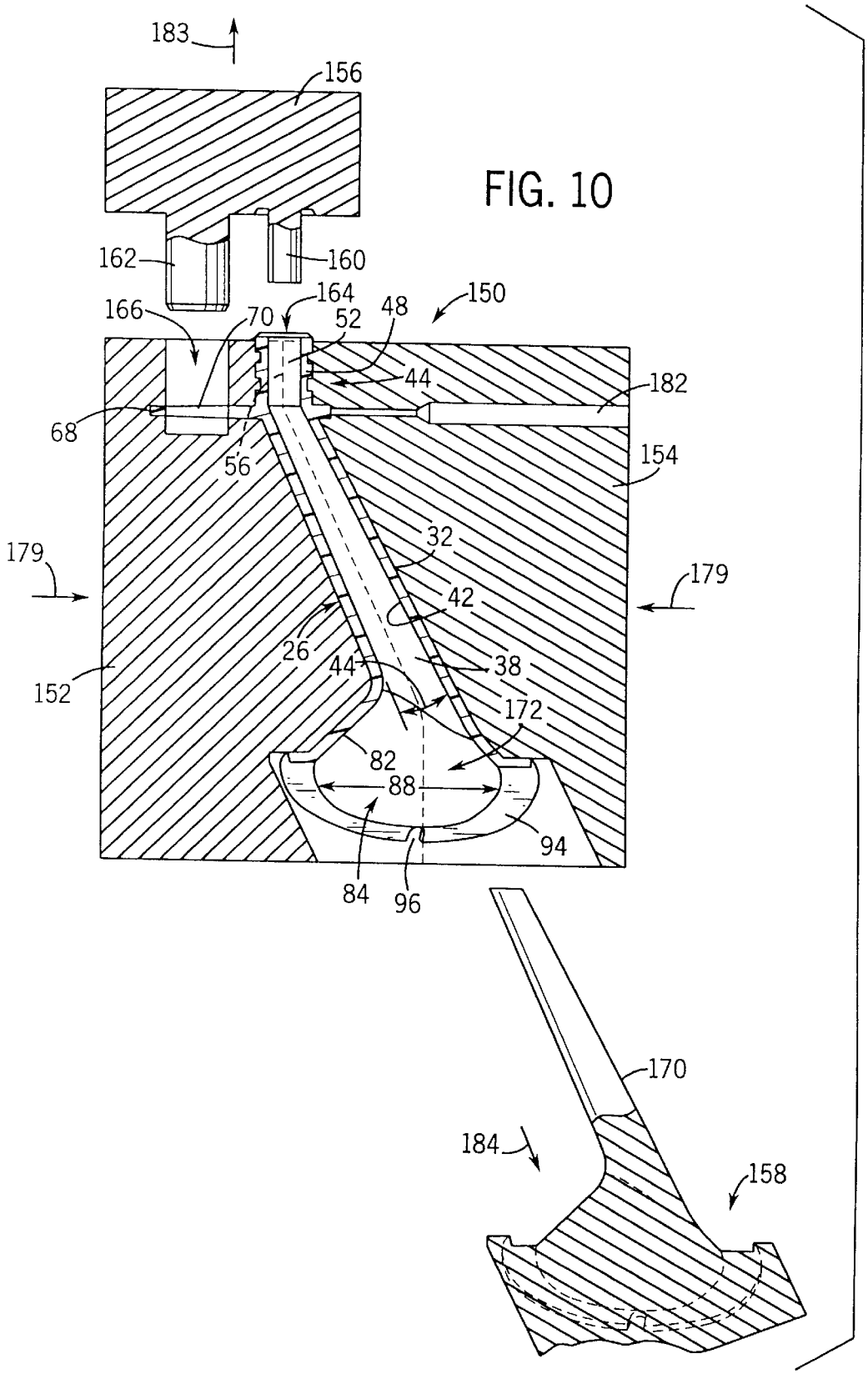
FIG. 10 is a side cross sectional view of the die just after forming the oil pickup tube and after removal of the cores.
Figure 11:
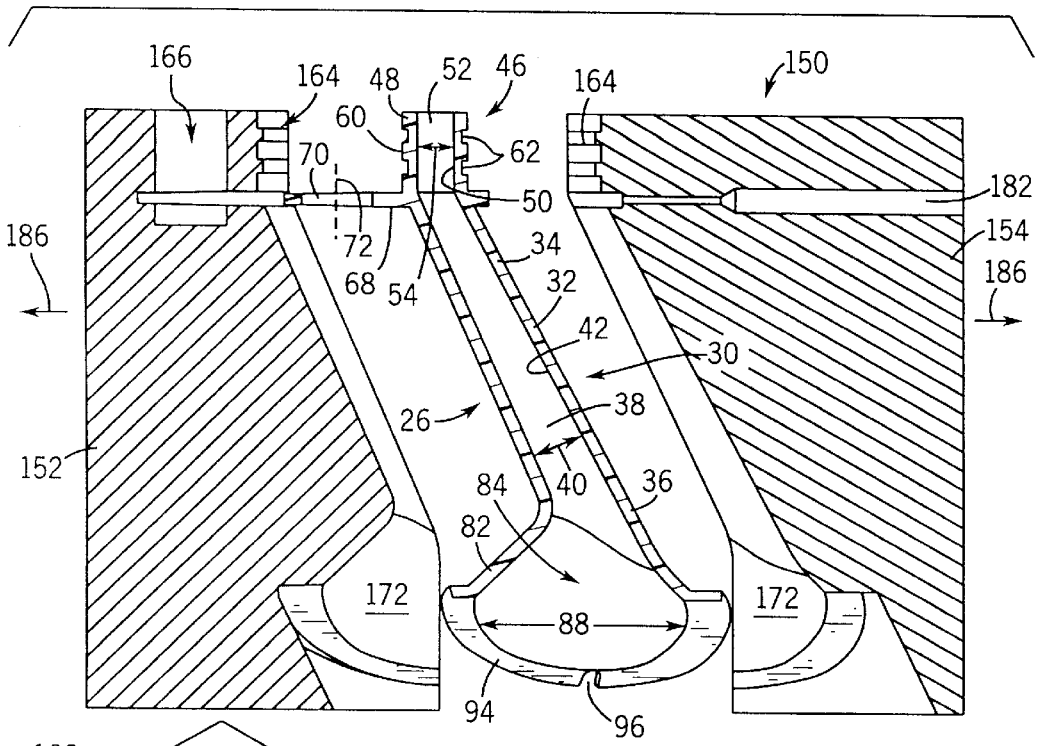
FIG. 11 is a side cross sectional view of the oil pickup tube being removed from the die.
Figure 12:
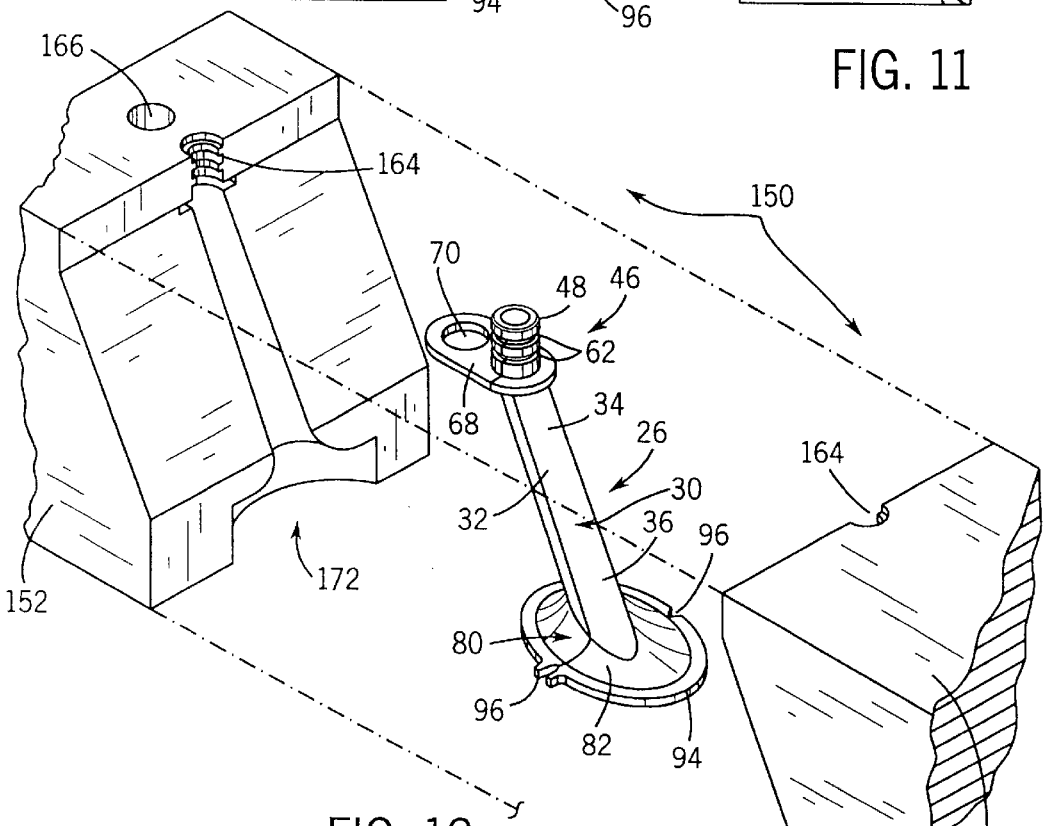
FIG. 12 is a perspective view of the oil pickup tube being removed from the die.

Referring now to FIGS. 10–12, when the plastic or other injected material has at least partially cooled and solidified, the first and second core members 156, 158 are removed in the respective directions 183, 184, and the two-piece die 150 is separated in the directions indicated by arrows 186, completing the manufacturing process.

Because of the geometry of the straight portion cavity 38 and the bottom portion cavity 84, the first and second core members 156, 158 are inserted into and removed from the die 150 substantially in the illustrated directions 179, 180, 181, 183, 184. The tabs 178 of the second core member 158 are angled substantially parallel to the direction 184 in which the second core member 158 is removed from the die 150 to facilitate such removal.

In the preferred method for manufacturing the oil pickup tube 26, the two-piece die 150 should be brought together prior to inserting the first core member 156 into the die 150. This is because the second aperture 166 of the two-piece die 150 is defined only by the first piece 152 of the two-piece die 150. The second core member 158 may be properly positioned prior to bringing the two-piece die 150 together, since the third aperture 172 is formed by both pieces 152, 154 of the two-piece die 150. The first core member 156 should be removed from the two-piece die 150 prior to separating the two pieces 152, 154 of the die 150, but the second core member 158 may be removed from the oil pickup tube 26 prior to or after separating the two pieces 152, 154 of the die 150.

Alternative methods may be used in which the first core member 156 includes only the top portion cavity pin 160, with the top flange aperture pin 162 being provided independent of the first core member 156. This would be particularly useful when the top flange aperture pin 162 is not inserted parallel to the top portion cavity pin 160. In this embodiment, either of the core members 156 or 158 may remain stationary with respect to the die 150 and the other core member 158 or 156 during manufacture of the oil pickup tube 26.

The outer surfaces of the cores 158, 156 correspond to shapes of the top, straight, and bottom portion cavities 52, 38, 84. The respective draft angles 58, 44, 91 allow the cores 158, 156 to be removed from the cavities 52, 38, 84.

Although particular embodiments of the present invention have been shown and described, other alternative embodiments will be apparent to those skilled in the art and are within the intended scope of the present invention. Thus, the present invention is to be limited only by the following claims.

What is claimed is:

1. An oil pickup tube for use in an internal combustion engine having an oil gallery with an oil inlet for receiving oil from the oil pickup tube, said tube comprising:

a substantially straight portion having at least one side wall, a top end that is positionable adjacent to the oil inlet of the oil gallery, and a bottom end; and a straight portion cavity having a substantially linear longitudinal axis extending in a direction from said top end to said bottom end, and a cavity width, said cavity being at least partially defined by said at least one side wall, and extending between said top end and said bottom end, both said substantially straight portion and said straight portion cavity being longer in the direction of said longitudinal axis than in a direction normal to said longitudinal axis, and wherein said width substantially monotonically increases from said top end to said bottom end.

2. The tube of claim 1, wherein said width monotonically increases from said top end to said bottom end without staying the same.

3. The tube of claim 1, wherein said straight portion cavity at least partially corresponds to the shape of at least one of a cone, a truncated cone, a pyramid, a truncated pyramid, and a frustum.

4. The tube of claim 1, further comprising a top flange interconnected with said tube, said flange facilitating securing said tube to the engine.

5. The tube of claim 4, wherein said top flange includes an aperture formed therein for facilitating securing said tube to the engine with a fastener.

6. The tube of claim 4, wherein said top flange is formed integrally with said tube.

7. The tube of claim 1, wherein said tube is made of plastic, and is made by a process selected from a group consisting of molding and casting.

8. The tube of claim 1, further comprising a top portion interconnected with said top end of said straight portion to form a junction between said top portion and said top end of said straight portion, said top portion including a top portion wall at least partially defining a top portion cavity in fluid flow communication with said straight portion cavity, said top portion cavity having a width that substantially monotonically increases from an end of said top portion adjacent said top end of said substantially straight portion to an opposite end.

9. The tube of claim 8, wherein said top portion cavity width monotonically increases without staying the same.

10. The tube of claim 8, wherein said top portion is formed integrally with said straight portion.

11. The tube of claim 8, wherein the top portion cavity at least partially corresponds to the shape of at least one of a cone, a truncated cone, a pyramid, a truncated pyramid, and a frustum.

12. The tube of claim 8, further comprising a top flange interconnected with said tube at said junction of said top portion and said straight portion, said top flange facilitating securing said tube to the engine.

13. The tube of claim 12, wherein said top flange is formed integrally with said tube.

14. The tube of claim 12, wherein said top portion cavity defines a longitudinal axis, and wherein said top flange defines a top flange aperture having a centerline substantially parallel to said longitudinal axis.

15. The tube of claim 8, wherein said top portion wall includes an outer surface, said outer surface defining at least one recess adapted to receive a sealing member, wherein said top portion is adapted to be inserted into an oil gallery of the engine to create a seal between said sealing member and the oil gallery and to place said top portion cavity in fluid flow communication between the oil gallery and said straight portion cavity.

16. The tube of claim 15, wherein the sealing member is an O-ring made of a resilient material.

17. The tube of claim 8, wherein said top portion cavity has a substantially linear longitudinal axis forming a non-zero angle with the axis of the straight portion cavity.

18. The tube of claim 1 further comprising a bottom portion having a bottom portion wall and a bottom portion cavity at least partially defined by said bottom portion wall, said bottom portion being interconnected with said bottom end of said straight portion such that said straight portion cavity is in fluid flow communication with said bottom portion cavity.

19. The tube of claim 18, wherein said bottom portion is formed integrally with said bottom end of said straight portion.

20. The tube of claim 18, wherein said bottom portion cavity includes a width that substantially monotonically increases from an end of said bottom portion immediately adjacent said bottom end of said straight portion to an opposite end, said bottom portion cavity at least partially corresponding to the shape of at least one of a cone, a truncated cone, a pyramid, a truncated pyramid, and a frustum.

21. The tube of claim 20, wherein said bottom portion width monotonically increases without staying the same.

22. The tube of claim 18, further comprising means for facilitating securing said bottom portion within the engine.

23. The tube of claim 18 further comprising a bottom flange interconnected with said bottom portion.

24. The tube of claim 23, wherein said bottom flange is integrally formed with said tube.

25. The tube of claim 23, wherein one of said bottom flange and a sump portion of the engine has formed therein at least one slot, and wherein said tube is adapted to be positioned in the sump portion of the engine, the other of the bottom flange and the sump portion including at least one rib that is received in said at least one slot to resist movement of said tube with respect to the sump portion.

26. The tube of claim 25, wherein said at least one slot includes a pair of opposed slots, and wherein said at least one rib includes a pair of ribs for being received in said pair of slots.

27. The tube of claim 18, wherein said bottom portion cavity has a substantially linear longitudinal axis forming a non-zero angle with the axis of the straight portion cavity.

28. An oil pickup tube for use in an internal combustion engine, said tube comprising:

a substantially straight portion having at least one side wall, a top end, and a bottom end;

a straight portion cavity having a substantially linear longitudinal axis and a cavity width, said cavity being at least partially defined by said at least one side wall, and extending between said top end and said bottom end, wherein said width substantially monotonically increases from said top end to said bottom end; and a bottom portion having a bottom portion wall and a bottom portion cavity at least partially defined by said bottom portion wall, and having a second substantially linear longitudinal axis forming a first non-zero angle with the axis of the straight portion cavity, said bottom end being in fluid flow communication with said bottom portion cavity.

29. The tube of claim 28, wherein said width monotonically increases from said top end to said bottom end without staying the same.

30. The tube of claim 28, wherein said straight portion cavity at least partially corresponds to the shape of at least one of a cone, a truncated cone, a pyramid, a truncated pyramid, and a frustum.

31. The tube of claim 28, further comprising a top flange interconnected with said tube, said flange facilitating securing said tube to the engine.

32. The tube of claim 31, wherein said top flange includes an aperture formed therein for facilitating securing said tube to the engine with a fastener.

33. The tube of claim 28, wherein said tube is made of plastic, and is made by a process selected from a group consisting of molding and casting.

34. The tube of claim 28, wherein said substantially straight portion and said straight portion cavity are elongated.

35. The tube of claim 28, wherein said bottom portion cavity includes a second width that substantially monotonically increases from an end of said bottom portion immediately adjacent said bottom end of said straight portion to an opposite end, said bottom portion cavity at least partially corresponding to the shape of at least one of a cone, a truncated cone, a pyramid, a truncated pyramid, and a frustum.

36. The tube of claim 35, wherein said second width monotonically increases without staying the same.

37. The tube of claim 28, further comprising means for facilitating securing said bottom portion within the engine.

38. The tube of claim 28 further comprising a bottom flange interconnected with said bottom portion.

39. The tube of claim 38, wherein said bottom flange is integrally formed with said tube.

40. The tube of claim 38, wherein one of said bottom flange and a sump portion of the engine has formed therein at least one sly, and wherein said tube is adapted to be positioned in the sump portion of the engine, the other of the bottom flange and the sump portion including at least one rib that is received in said at least one slot to resist movement of said tube with respect to the sump portion.

41. The tube of claim 40, wherein said at least one slot includes a pair of opposed slots, and wherein said at least one rib includes a pair of ribs for being received in said pair of slots.

42. The tube of claim 28, further comprising a top portion interconnected with said top end to form a junction between said top portion and said top end, said top portion including a top portion wall at least partially defining a top portion cavity in fluid flow communication with said straight portion cavity, said top portion cavity having a third substantially linear longitudinal axis forming a second non-zero angle with the axis of the straight portion cavity.

43. The tube of claim 42, wherein said top portion cavity includes a third width that substantially monotonically increases from a first end of said top portion adjacent said top end to an opposite end.

44. The tube of claim 43, wherein said third width monotonically increases without staying the same.

45. The tube of claim 42, wherein the top portion cavity at least partially corresponds to the shape of at least one of a cone, a truncated cone, a pyramid, a truncated pyramid, and a frustum.

46. The tube of claim 42, further comprising a top flange interconnected with said tube at said junction of said top portion and said straight portion, said top flange facilitating securing said tube to the engine.

47. The tube of claim 46, wherein said top flange defines a top flange aperture having a centerline substantially parallel to said third substantially linear longitudinal axis.

48. The tube of claim 42, wherein said top portion wall includes an outer surface, said outer surface defining at least one recess adapted to receive a sealing member, wherein said top portion is adapted to be inserted into an oil gallery of the engine to create a seal between said sealing member and the oil gallery and to place said top portion cavity in fluid flow communication between the oil gallery and said straight portion cavity.

49. An oil pickup tube for use in an internal combustion engine, said tube comprising:

a substantially straight portion having at least one side wall, a top end, and a bottom end;

a straight portion cavity having a substantially linear longitudinal axis and a cavity width, said cavity being at least partially defined by said at least one side wall, and extending between said top end and said bottom end, wherein said width substantially monotonically increases from said top end to said bottom end; and a bottom portion having a bottom portion wall and a bottom portion cavity at least partially defined by said bottom portion, said bottom portion being interconnected with said bottom end of said straight portion such that said straight portion cavity is in fluid flow communication with said bottom portion cavity; and a bottom flange interconnected with said bottom portion.

50. The tube of claim 49, wherein said bottom flange is integrally formed with said tube.

51. The tube of claim 49, wherein one of said bottom flange and a sump portion of the engine has formed therein at least one slot, and wherein said tube is adapted to be positioned in the sump portion of the engine, the other of the bottom flange and the sump portion including at least one rib that is received in said at least one slot to resist movement of said tube with respect to the sump portion.

52. The tube of claim 51, wherein said at least one slot includes a pair of opposed slots, and wherein said at least one rib includes a pair of ribs for being received in said pair of slots.

53. An oil pickup tube for use in an internal combustion engine, said tube comprising:

a substantially straight portion having at least one side wall, a top end, and a bottom end;

a straight portion cavity having a substantially linear longitudinal axis and a cavity width, said cavity being at least partially defined by said at least one side wall, and extending between said top end and said bottom end, wherein said width substantially monotonically increases from said top end to said bottom end; and a bottom portion having a bottom portion wall and a bottom portion cavity at least partially defined by said bottom portion wall, and having a second substantially linear longitudinal axis forming a first non-zero angle with the axis of the straight portion cavity, said first non-zero angle being selected such that the tube can be molded in one piece from a plastic material, and said bottom end being in fluid flow communication with said bottom portion cavity.

54. The tube of claim 53, wherein said width monotonically increases from said top end to said bottom end without staying the same.

55. The tube of claim 53, wherein said straight portion cavity at least partially corresponds to the shape of at least one of a cone, a truncated cone, a pyramid, a truncated pyramid, and a frustum.

56. The tube of claim 53, further comprising a top flange interconnected with said tube, said flange facilitating securing said tube to the engine.

57. The tube of claim 56, wherein said top flange includes an aperture formed therein for facilitating securing said tube to the engine with a fastener.

58. The tube of claim 53, wherein said substantially straight portion and said straight portion cavity are elongated.

59. The tube of claim 53, wherein said bottom portion cavity includes a second width that substantially monotonically increases from an end of said bottom portion immediately adjacent said-bottom end of said straight portion to an opposite end, said bottom portion cavity at least partially corresponding to the shape of at least one of a cone, a truncated cone, a pyramid, a truncated pyramid, and a frustum.

60. The tube of claim 53, further comprising means for facilitating securing said bottom portion within the engine.

61. The tube of claim 53 further comprising a bottom flange interconnected with said bottom portion.

62. The tube of claim 61, wherein one of said bottom flange and a sump portion of the engine has formed therein at least one slot, and wherein said tube is adapted to be positioned in the sump portion of the engine, the other of the bottom flange and the sump portion including at least one rib that is received in said at least one slot to resist movement of said tube with respect to the sump portion.

63. The tube of claim 62, wherein said at least one slot includes a pair of opposed slots, and wherein said at least one rib includes a pair of ribs for being received in said pair of slots.

64. The tube of claim 53, further comprising a top portion interconnected with said top end to form a junction between said top portion and said top end, said top portion including a top portion wall at least partially defining a top portion cavity in fluid flow communication with said straight portion cavity, said top portion cavity having a third substantially linear longitudinal axis forming a second non-zero angle with the axis of the straight portion cavity.

65. The tube of claim 64, wherein said second non-zero angle being selected such that the tube can be molded in one piece from a plastic material.

66. The tube of claim 64, wherein said top portion cavity includes a third width that substantially monotonically increases from a first end of said top portion adjacent said top end to an opposite end.

67. The tube of claim 64, further comprising a top flange interconnected with said tube at said junction of said top portion and said straight portion, said top flange facilitating securing said tube to the engine.

68. An oil pickup tube for use in an internal combustion engine, said tube comprising:

an elongated substantially straight portion having at least one side wall, a top end, and a bottom end;

an elongated straight portion cavity having a substantially linear longitudinal axis and a cavity width, said cavity being at least partially defined by said at least one side wall and extending between said top end and said bottom end, wherein said width substantially monotonically increases from said top end to said bottom end;

a top portion interconnected with said top end of said elongated straight portion to form a junction between said top portion and said top end of said elongated straight portion, said top portion including a top portion wall at least partially defining a top portion cavity in fluid flow communication with said elongated straight portion cavity, said top portion cavity having a width that substantially monotonically increases from an end of said top portion adjacent said top end of said elongated substantially straight portion to an opposite end; and a top flange interconnected with said tube at said junction of said top portion and said elongated straight portion, said top flange facilitating securing said tube to the engine.

69. The tube of claim 68, wherein said top flange is formed integrally with said tube.

70. The tube of claim 68, wherein said top portion cavity defines a longitudinal axis, and wherein said top flange defines a top flange aperture having a centerline substantially parallel to said longitudinal axis.

71. An oil pickup tube for use in an internal combustion engine, said tube comprising:

an elongated substantially straight portion having at least one side wall, a top end, and a bottom end;

an elongated straight portion cavity having a substantially linear longitudinal axis and a cavity width, said cavity being at least partially defined by said at least one side wall, and extending between said top end and said bottom end, wherein said width substantially monotonically increases from said top end to said bottom end; and a top portion interconnected with said top end of said elongated straight portion to form a junction between said top portion and said top end of said elongated straight portion, said top portion including a top portion wall at least partially defining a top portion cavity in fluid flow communication with said elongated straight portion cavity, said top portion cavity having a width that substantially monotonically increases from an end of said top portion adjacent said top end of said elongated substantially straight portion to an opposite end;

wherein said top portion wall includes an outer surface, said outer surface defining at least one recess adapted to receive a sealing member, wherein said top portion is adapted to be inserted into an oil gallery of the engine to create a seal between said sealing member and the oil gallery and to place said top portion cavity in fluid flow communication between the oil gallery and said elongated straight portion cavity.

72. The tube of claim 71, wherein the sealing member is an O-ring made of a resilient material.

73. An oil pickup tube for use in an internal combustion engine, said tube comprising:

an elongated substantially straight portion having at least one side wall, a top end, and a bottom end;

an elongated straight portion cavity having a substantially linear longitudinal axis and a cavity width, said cavity being at least partially defined by said at least one side wall, and extending between said top end and said bottom end, wherein said width substantially monotonically increases from said top end to said bottom end;

a bottom portion having a bottom portion wall and a bottom portion cavity at least partially defined by said bottom portion wall, said bottom portion being interconnected with said bottom end of said elongated straight portion such that said elongated straight portion cavity is in fluid flow communication with said bottom portion cavity; and a bottom flange interconnected with said bottom portion.

74. The tube of claim 73, wherein said bottom flange is integrally formed with said tube.

75. The tube of claim 73, wherein one of said bottom flange and a sump portion of the engine has formed therein at least one slot, and wherein said tube is adapted to be positioned in the sump portion of the engine, the other of the bottom flange and the sump portion including at least one rib that is received in said at least one slot to resist movement of said tube with respect to the sump portion.

76. The tube of claim 75, wherein said at least one slot includes a pair of opposed slots, and wherein said at least one rib includes a pair of ribs for being received in said pair of slots.

77. An oil pickup tube for use in an internal combustion engine having an oil gallery with an oil inlet for receiving oil from the oil pickup tube, said tube comprising:

a substantially straight portion having at least one side wall, a top end that is positionable adjacent to the oil inlet of the oil gallery, and a bottom end;

a straight portion cavity having a substantially linear first longitudinal axis extending in a direction from said top end to said bottom end, and a straight portion cavity width that substantially monotonically increases in the direction of said first longitudinal axis from said top end to said bottom end at a first rate of change;

a bottom portion having a bottom portion wall, a top end immediately adjacent said bottom end of said straight portion, and a bottom end; and a bottom portion cavity having a substantially linear second longitudinal axis extending in a direction from said top end of said bottom portion to said bottom end of said bottom portion, and a bottom portion cavity width that substantially monotonically increases in the direction of said second longitudinal axis from said top end of said bottom portion to said bottom end of said bottom portion at a second rate of change that is greater than said first rate of change, said bottom portion being interconnected with said bottom end of said straight portion such that said straight portion cavity is in fluid flow communication with said bottom portion cavity.

* * * * *

UNITED STATES PATENT AND TRADEMARK OFFICE

CERTIFICATE OF CORRECTION

PATENT NO. : 6,142,257
DATED : November 7, 2000
INVENTOR(S) : Patrick Bruener and Glen Eifert It is certified that error appears in the above-identified patent and that said Letters Patent is hereby corrected as shown below:

Column 11, claim 40,
Line 11, delete "sly" and insert -- slot --.

Signed and Sealed this

Sixth Day of November, 2001

*Attest:*

Nicholas P. Godici

*Attesting Officer*

NICHOLAS P. GODICI
*Acting Director of the United States Patent and Trademark Office*